US008439187B2

(12) United States Patent
Tumminia et al.

(10) Patent No.: US 8,439,187 B2
(45) Date of Patent: May 14, 2013

(54) SHIPPING AND DISPLAY CONTAINER WITH REMOVABLE PANEL

(75) Inventors: Patricia A. Tumminia, Lombard, IL (US); Nicholas A. Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 13/299,436

(22) Filed: Nov. 18, 2011

(65) Prior Publication Data

US 2012/0132562 A1 May 31, 2012

Related U.S. Application Data

(60) Provisional application No. 61/417,640, filed on Nov. 29, 2010.

(51) Int. Cl.
*B65D 51/00* (2006.01)
*B65D 25/00* (2006.01)

(52) U.S. Cl.
USPC ..... 206/45.29; 206/768

(58) Field of Classification Search ..... 206/45.28–45.3, 206/736, 738, 739, 746, 767–769, 774; 229/103, 229/122, 125.01, 125.03, 125.14, 125.15, 229/125.19, 125.21, 125.33, 125.35, 240
See application file for complete search history.

(56) References Cited

U.S. PATENT DOCUMENTS

| | | | | |
|---|---|---|---|---|
| 1,649,211 | A | 11/1927 | Bitzer | |
| 2,477,902 | A * | 8/1949 | Scandore | 206/767 |
| 2,583,211 | A | 1/1952 | Fleming | |
| 2,771,986 | A * | 11/1956 | Bekoff | 206/45.3 |
| 3,850,291 | A * | 11/1974 | Kinderman | 206/45.28 |
| 4,417,655 | A | 11/1983 | Forbes, Jr. | |
| 4,673,126 | A | 6/1987 | Hambleton | |
| 5,507,430 | A | 4/1996 | Imhoff | |
| 5,555,982 | A | 9/1996 | Kuhn et al. | |
| 5,657,872 | A | 8/1997 | Leftwich et al. | |
| 6,158,579 | A * | 12/2000 | Rosenbaum | 206/45.29 |
| 6,189,780 | B1 | 2/2001 | Kanter | |
| 6,932,265 | B2 | 8/2005 | Sax et al. | |
| 7,080,736 | B2 | 7/2006 | Jackson et al. | |
| 7,658,318 | B2 | 2/2010 | Walsh et al. | |
| 2004/0074956 | A1 | 4/2004 | Sax et al. | |
| 2005/0263434 | A1 | 12/2005 | Tibbels | |

FOREIGN PATENT DOCUMENTS

| | | |
|---|---|---|
| GB | 2459373 | 10/2009 |
| WO | 03082681 | 10/2003 |
| WO | 2008086582 | 7/2008 |

* cited by examiner

*Primary Examiner* — Bryon Gehman
(74) *Attorney, Agent, or Firm* — Matthew W. Eslami

(57) ABSTRACT

A shipping container convertible into a display container comprises a case having sidewalls, a closed bottom, and an open top. A separate cover is secured to and closes the open top. The cover comprises a lid panel coextensive in length and width with the open top. A flange depending from each of the side edges of the lid panel and attached to upper outer surfaces of the case sidewalls to secure the cover to the case. A detachable display panel is formed in the lid panel. A detachable protective panel is foldably attached to one side edge of the lid panel by weakened tear lines. The protective panel is attached to the display panel, whereby removal of the protective panel carries with it and removes the display panel to form a display opening in the lid panel for display of and access to product contained in the container.

10 Claims, 10 Drawing Sheets

SHIPPING AND DISPLAY CONTAINER WITH REMOVABLE PANEL

CROSS REFERENCE TO RELATED APPLICATIONS

This application claims priority to US provisional patent application Ser. No. 61/417,640, filed on 29 Nov. 2010, which is hereby incorporated hereinto by reference as if fully restated herein.

FIELD OF THE INVENTION

This invention relates to containers that are convertible from a shipping configuration to a display configuration. More particularly, the invention relates to a shipping and display container with a removable panel that protects graphics during shipping and that can be removed at the point of sale to form an opening for display and access to the product within the container.

BACKGROUND OF THE INVENTION

Containers made of corrugated paperboard are widely used to ship goods from a point of manufacture or other location to a point of sale. When transporting finished products from the point of manufacture or other location to the point of sale, or to an intermediate storage facility, it is often desirable to enclose a quantity of products or smaller retail packages within a larger, more durable shipping container. Not only does this preserve the products in their desired, saleable condition, but it minimizes the number of individual items to be handled and generally provides more uniformly shaped items for stacking and handling. Typical shipping containers comprise rectangular boxes with four sidewalls and top and bottom flaps glued closed over the top and bottom of the box. While such containers have proven effective in protecting the finished products during transport and storage, they are generally inappropriate for retail display, and retailers typically remove the individual product items from the container and place them individually on store shelving.

Although removal of individual product items from the shipping container and placing them individually on store shelving is suitable in some cases, the practice of displaying goods in shipping containers has become more popular with the advent of large warehouse style stores and supermarkets where the containers are stacked on top of one another on the retail floor.

In attempting to adapt a conventional shipping container for display of the product items held therein, a retailer might use a cutting implement to cut away a section of the shipping container to form an opening for display of and access to the product items. However, the use of cutting implements to open cases can damage the products and can weaken the container to the point that it cannot be safely stacked with other containers.

In an effort to provide a container more suitable for displaying products in a retail setting, containers have been developed which are convertible to an open display configuration upon reaching the point of sale. Containers of this variety include those of a generally tray-like configuration with a removable cover. Although representing an improvement over conventional corrugated shipping containers, these containers still offer somewhat limited product access, particularly when such containers are in the midst of a stack of containers extending above and below.

Another type of display container has one or more removable sections or display panels typically defined by perforated tear lines. Such containers are generally formed from a one-piece blank suitably cut, scored, and perforated to enable subsequent folding of the blank into the final closed container. After receiving the packaged goods, the retailer removes the display panel from the container to provide access to the goods even when the container is stacked. However, a line or lines of perforations can weaken the box in its shipping configuration and reduce its protection performance, and/or it leaves too jagged an edge and reduces the visual appeal of the container when the display panel is removed at the point of sale.

Another important consideration with the design of a shipping container convertible to a display container is the compatibility of the container with existing automated manufacturing and packaging equipment. Containers are typically made on automated production lines. Any suitable container design should be compatible with such production equipment. Further, the packagers typically use automated packaging lines which assemble the container from a flat knocked down state and load the container with goods prior to the container being closed. Any design of a shipping container convertible to a display container should be compatible with automated packaging equipment.

A further important consideration is economy of manufacture. Regular slotted carton ("RSC") and half slotted carton ("HSC") boxes have been known in the art of shipping containers for many years. The RSC and HSC boxes are highly economical shipping containers due to the fact that there is very little manufacturing waste. Further, due to their rectangular shape they are well suited to shipping goods via cargo container, truck, train, or any other means of transport in which efficient use of space is a priority. As a result, RSC and HSC boxes are widely used for shipping and storing many different types of goods.

The RSC and HSC boxes are each formed from a single rectangular blank, typically of corrugated paperboard and have four rectangular sidewall panels. The RSC box has flaps on both the top and bottom edges of the sidewalls, and the HSC box has flaps only on the bottom edges of the sidewalls. The HSC box typically is used with a separate lid or cover, or is inserted into another box that forms a closure for the open top. In order to erect these boxes from a rectangular blank, four crush folds are made parallel to the depth of the box to define the four sidewall panels, and further crush folds are made parallel to the length and width of the box to define upper and lower flaps in the case of a RSC box, or to form lower flaps in the case of a HSC box. Either style of box is articulated by folding along the crush folds so that the sidewall panels are disposed at right angles to one another and the flap panels are folded inwardly to close the top and bottom of the box (RSC) or the bottom of the box (HSC), with the flaps associated with the shorter sides of the box being folded inwardly first, followed by the flaps associated with the longer sides. The flaps are then secured in closed position by any suitable means, such as tape, adhesive, staples, etc. The bottom side of either style box typically is closed first, the desired goods are then inserted into the box, and the top side is then closed. However, the box may instead be articulated around the goods themselves and the top and bottom closed thereafter.

One significant disadvantage of the RSC and HSC boxes, however, is the fact that such boxes are not well suited for use as display containers in a retail environment. This is due to the fact that the goods within opened RSC and HSC boxes are not visible, other than from the top, unless a portion of one or more sidewall panels is first separated from the box by means of cutting or tearing. Not only does this require additional effort on the part of the retailer, it also tends to result in an unattractive display container having rough, uneven edges, which can be unsightly in the retail environment.

As a result, goods shipped in an RSC or HSC box typically are removed from the box upon arrival at the vending location and placed on shelves or into other containers for display, with the box then simply being discarded. This results in both a significant expenditure of time on the part of the retailer in transferring the goods from the shipping boxes to the display environment, as well as added expense in the form of shelving or display bins for such goods.

A further disadvantage of the RSC and HSC boxes is they are not well-adapted for displaying high-impact graphics thereon. As a result, when such containers are used to store and display goods in a retail environment, for example in warehouse stores where shipping containers are often placed directly on the sales floor, there is little potential of providing high-impact sales copy or advertising on such containers.

Accordingly, there is need for a shipping container that can utilize a HSC box design with a cover that can accommodate high end graphics, that has a removable display panel that enables the container to be easily converted to a display container at the point of sale without requiring the use of cutting implements to form an access and display opening, that may be stacked with other containers without obscuring the display opening, that leaves a clean edge for enhanced visual appeal when the display panel is removed, that can be manufactured and filled using existing manufacturing and packaging equipment with minimal changes to the equipment, that is capable of receiving high end graphics, and that has a protective outer panel overlying the removable display panel during shipping to protect graphics and strengthen lines of weakness that permit easy removal of the display panel.

SUMMARY OF THE INVENTION

The shipping and display container of the invention comprises a main case with four sidewalls and bottom closure flaps as in a conventional HSC box, with a separate cover adhered to and closing its top end. This construction enables a customer to utilize current manufacturing equipment to make and erect the case and to use existing filling equipment to place product in the case.

The cover is constructed to increase visual appeal, while at the same time minimizing cost. The main case can have generic graphics applied to it and the cover can have specialized graphics. The cover is of one-piece construction and includes an inner lid panel with a line of perforations defining a removable display panel, and an outer protective panel that overlies the lid panel and display panel and is adhesively attached to the display panel. When the end user pulls the protective panel off via a pull slot, the internal display panel is pulled along with it and "pops" out, forming a clean, aesthetic display window and revealing the product. The cover construction allows for easy and clean removal of the display panel to form a display opening at a point of sale.

The case is shipped erect to a location where it is to be filled with product. The cover is shipped flat and applied to the case after the case is filled with product. External flanges on all four sides of the cover are folded down and adhered to the upper outside surfaces of the respective case sidewalls to secure the cover in place. The protective panel attached to one side of the cover is reversely folded and adhered to the removable display panel, and during shipping protects graphics on the margins of the cover and provides reinforcement to the lines of perforation securing the display panel to the cover. The flanges provide containment, graphic appeal, and structural integrity to the container. At the point of sale the protective outer panel and inner display panel are removed as a unit and the container is placed on its side with the product access and display opening facing forwardly.

More specifically, the present invention comprises a shipping container convertible into a display container at a point of sale, wherein the container comprises a case having sidewalls, a closed bottom, and an open top. A separate cover is secured to and closes the open top. The cover comprises a lid panel coextensive in length and width with the open top and the lid panel has opposite side edges. A flange depending from each of the side edges of the lid panel, the flanges attached to upper outer surfaces of the case sidewalls to secure the cover to the case. A detachable display panel is formed in the lid panel by weakened tear lines in the lid panel extending around a border portion of the lid panel spaced inwardly from the side edges thereof. The display panel extending over a substantial portion of the lid panel and surface portions of the lid panel between the tear lines and the side edges of the lid panel defining surfaces for receipt of high end graphics. A detachable protective panel is foldably attached to one side edge of the lid panel by weakened tear lines. The protective panel is folded inwardly over the lid panel and is attached to the display panel, whereby removal of the protective panel carries with it and removes the display panel to form a display opening in the lid panel for display of and access to product contained in the container.

The case and cover can be die cut and the case can have full overlap flaps (FOL) or flaps that meet in the middle of the case. The entire case can be printed or spot labeled. A die cut HSC case with the cover of the invention can have high end graphics. A die cut tray can be used in place of the HSC case, with the same cover applied as would be applied to the HSC case. The bottom flaps of the case may be secured closed by the use of tape, staples, adhesive or other suitable fastening means.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
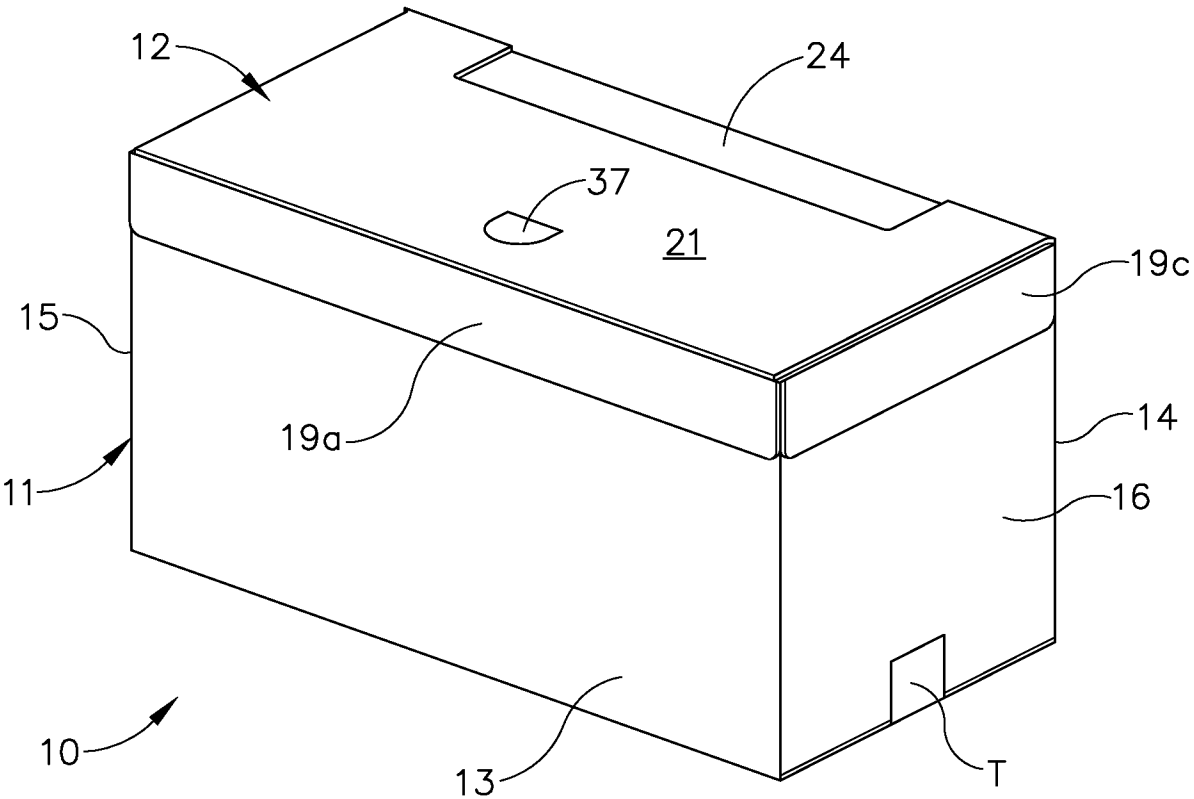
FIG. 1 is a top perspective view of a container according to the invention.

A container according to the invention is indicated generally at 10 in FIG. 1 in its shipping configuration. The container comprises a case 11 and a separate cover 12 closing the top of the case. The case preferably is of rectangular configuration, preferably in the style of a HSC box with opposed parallel sidewalls 13 and 14, opposed parallel end walls 15 and 16, and major bottom flaps 17*a*, 17*b* and minor bottom flaps 18*a*, 18*b* (see FIGS. 7 and 8) closing the bottom of the case. Depending flanges 19*a*-19*d* on opposite side and end edges of the cover are adhered to the outer top surfaces of the case side and end walls to secure the cover to the case.

As seen best in FIGS. 2-6 and 10, the cover comprises a flat rectangular lid panel 20 that extends the length and width of the case, an outer protective panel 21 coextensive in length and width with the lid panel and foldably attached along spaced collinear frangible tear lines 22 and 23 to one edge of the lid panel, a tear-out or detachable display panel 24 extending over a substantial part of the lid panel and delineated by frangible tear lines 25, 26, 27 and 28, with the flanges 19*a*-19*d* foldably attached along fold lines 29, 30, 31 and 32 to opposite side and end edges, respectively, of the lid panel. Fold line 32 is substantially collinear with the tear lines 22 and 23.

The tear lines 25, 26 and 27 are spaced inwardly from the edges of the lid panel, leaving surface areas 33, 34 and 35 at margins of the lid panel. Terminal end portions of the tear lines 26 and 27 extend past opposite ends of the fold line 32 and into the protective panel 21, with tear line 28 connected between the terminal ends so that it lies in the protective panel spaced from and parallel to the fold line 32 and tear lines 22 and 23. The terminal end portions of tear lines 26 and 27 together with the tear line 28 and fold line 32 delineate flap 19*d*.

Figure 4:
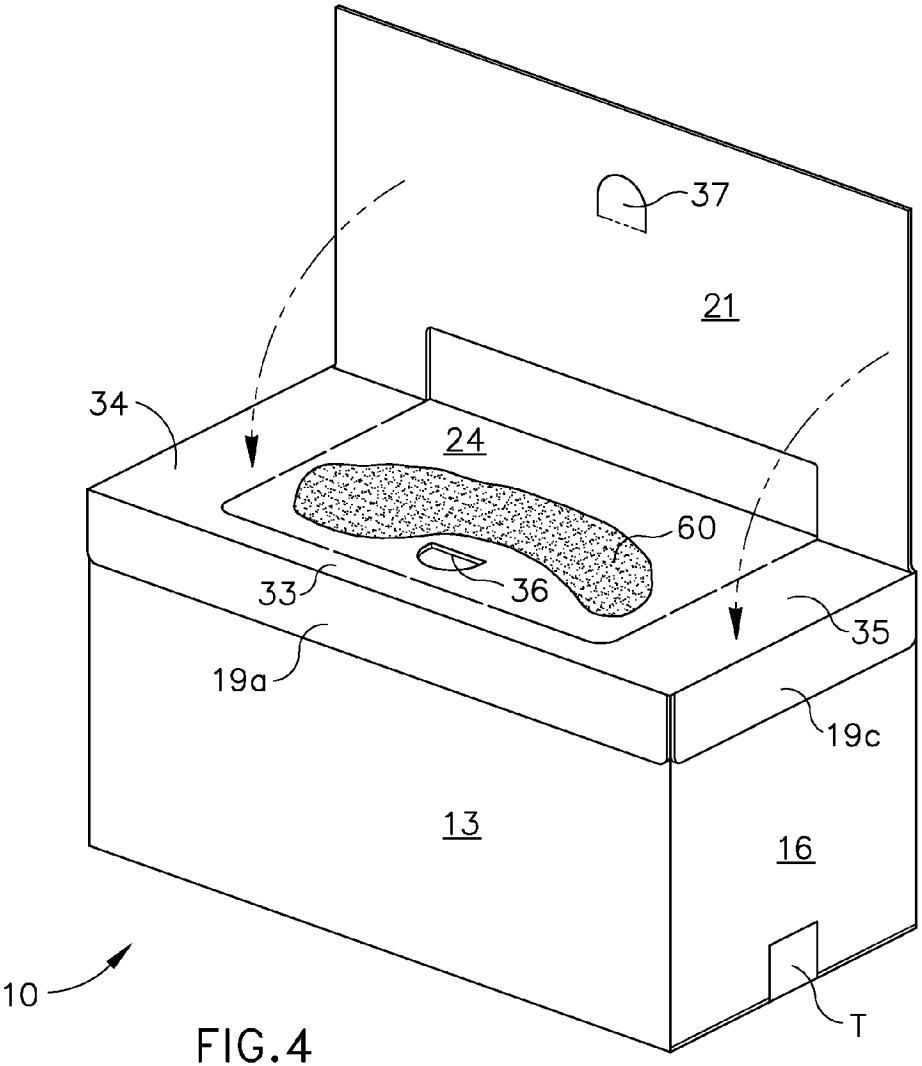
FIG. 4 is a front top perspective view of the container shown in FIG. 3.
Figure 5:
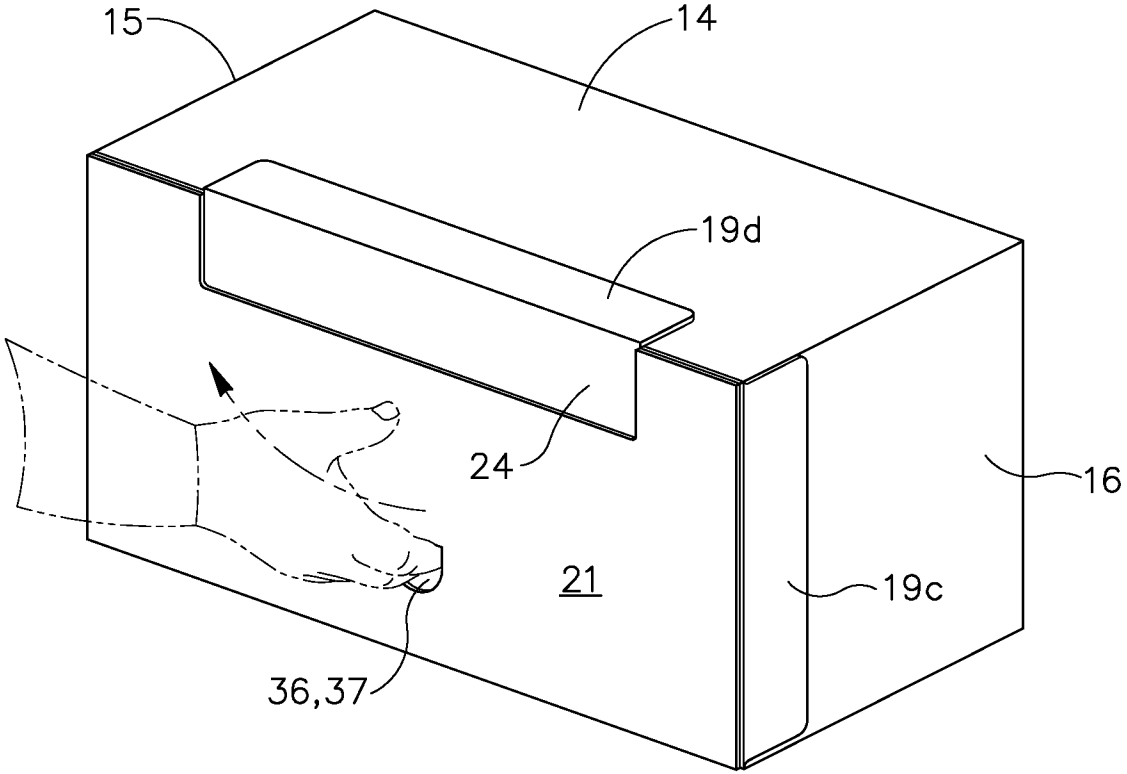
FIG. 5 is a front perspective view of the container, depicting a user grasping the thumb pull preparatory to removing the protective panel and display panel.

A shaped opening 36 is formed in the display panel 24 adjacent the edge thereof opposite the fold 32 and midway between opposite side edges thereof, and a correspondingly shaped punch-out tab 37 is formed in the protective panel 21 in a position to overlie the opening 36 when the protective panel is folded over the lid panel as shown in FIGS. 1, 4 and 5. The tab 37 is defined by a substantially U-shaped perforated line 38 terminating at its opposite ends at opposite ends of a fold line 39. Although the tab is U-shaped but other shapes such as semi-circle, D-shape or the like are within the scope of the present invention.

Figure 2:
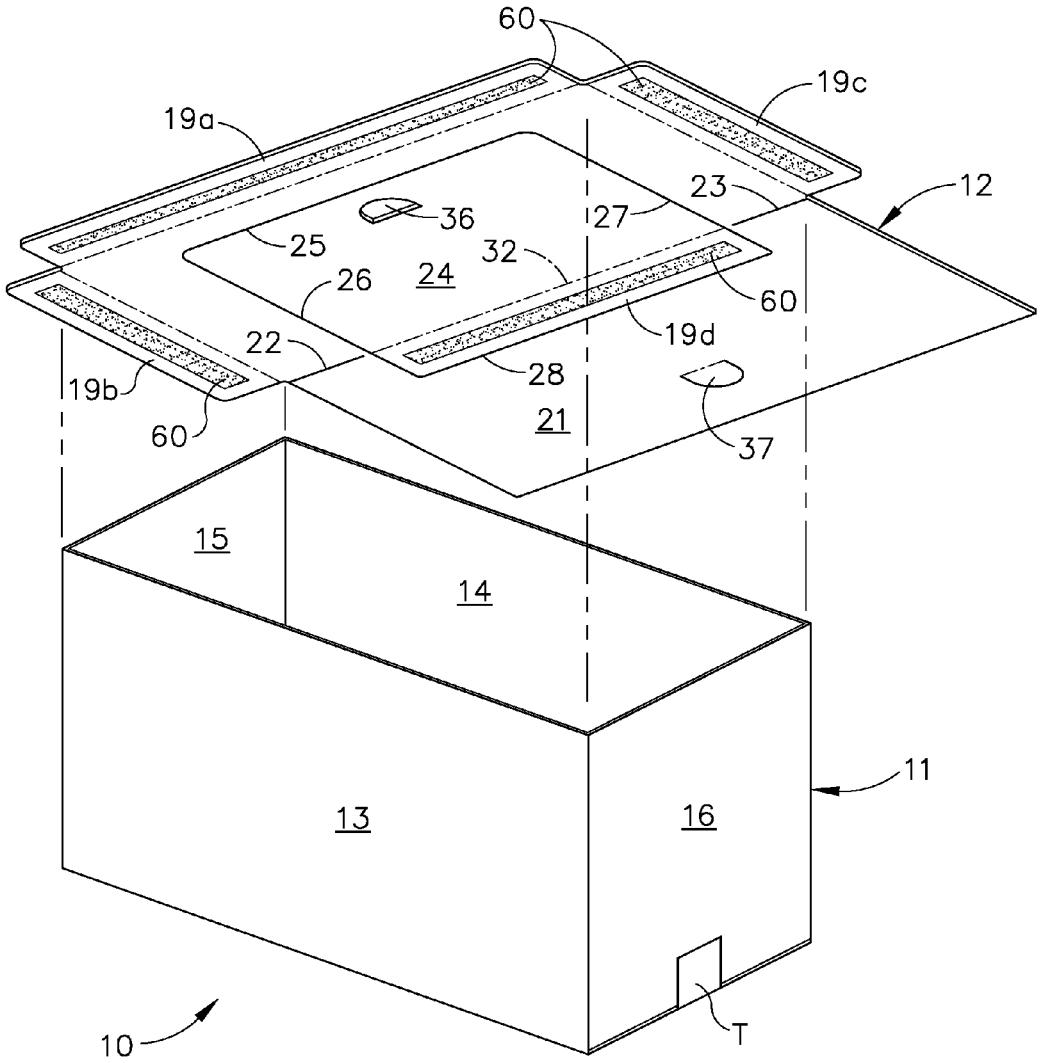
FIG. 2 is an exploded top perspective view of the container of the invention, showing the cover of the invention in its flat configuration and in position to be applied to the case.
Figure 3:
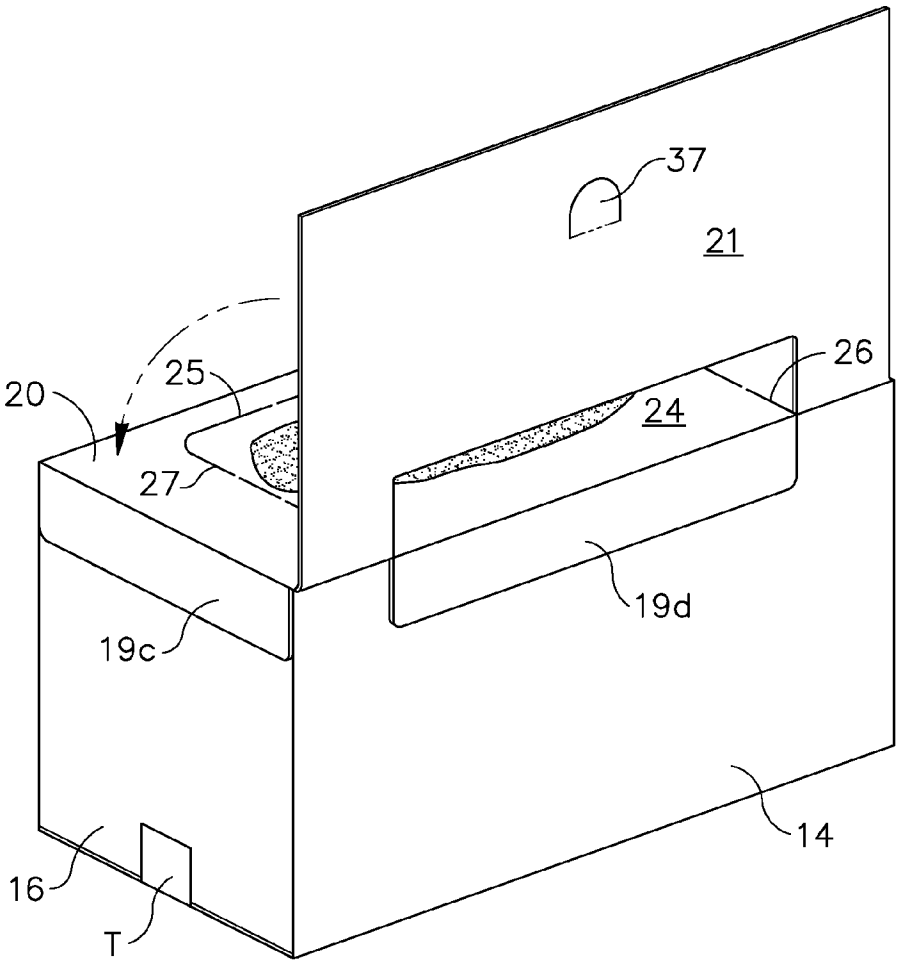
FIG. 3 is a rear top perspective view of the container of the invention, with the flanges of the cover folded down and adhered to the case, and the protective panel in a partially reversed folded position prior to being adhered to the removable display panel.
Figure 6:
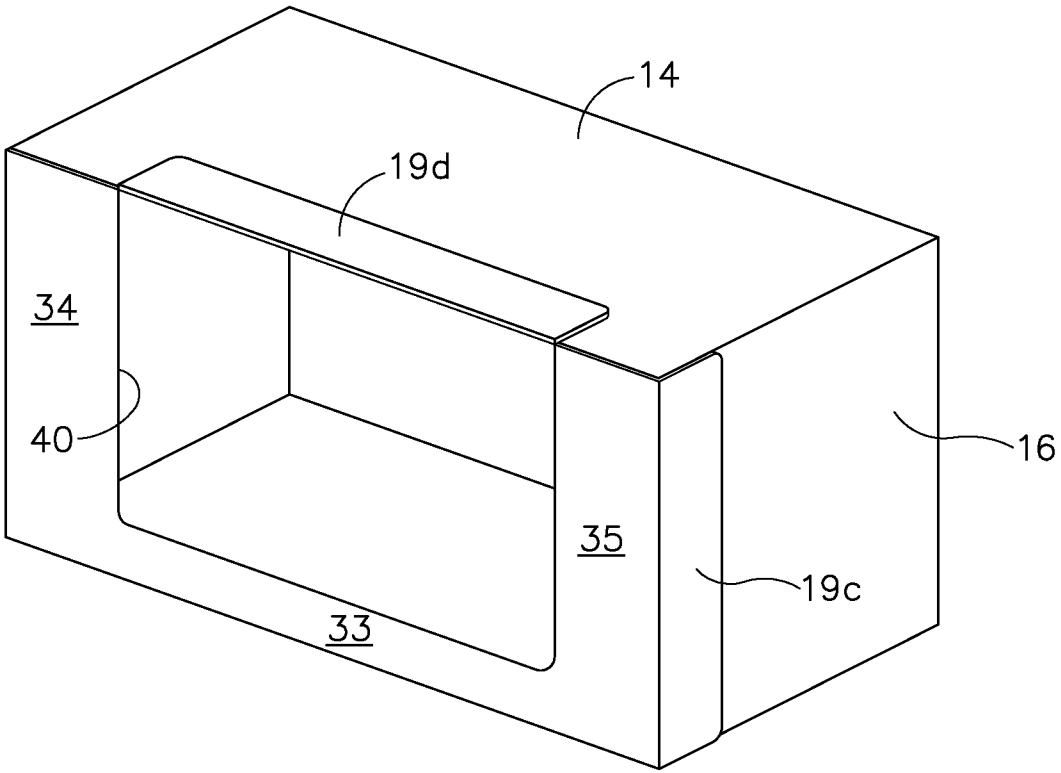
FIG. 6 is a front perspective view of the container in its operative use position with the protective panel and display panel removed and the display opening in a forwardly facing orientation.
Figure 8:
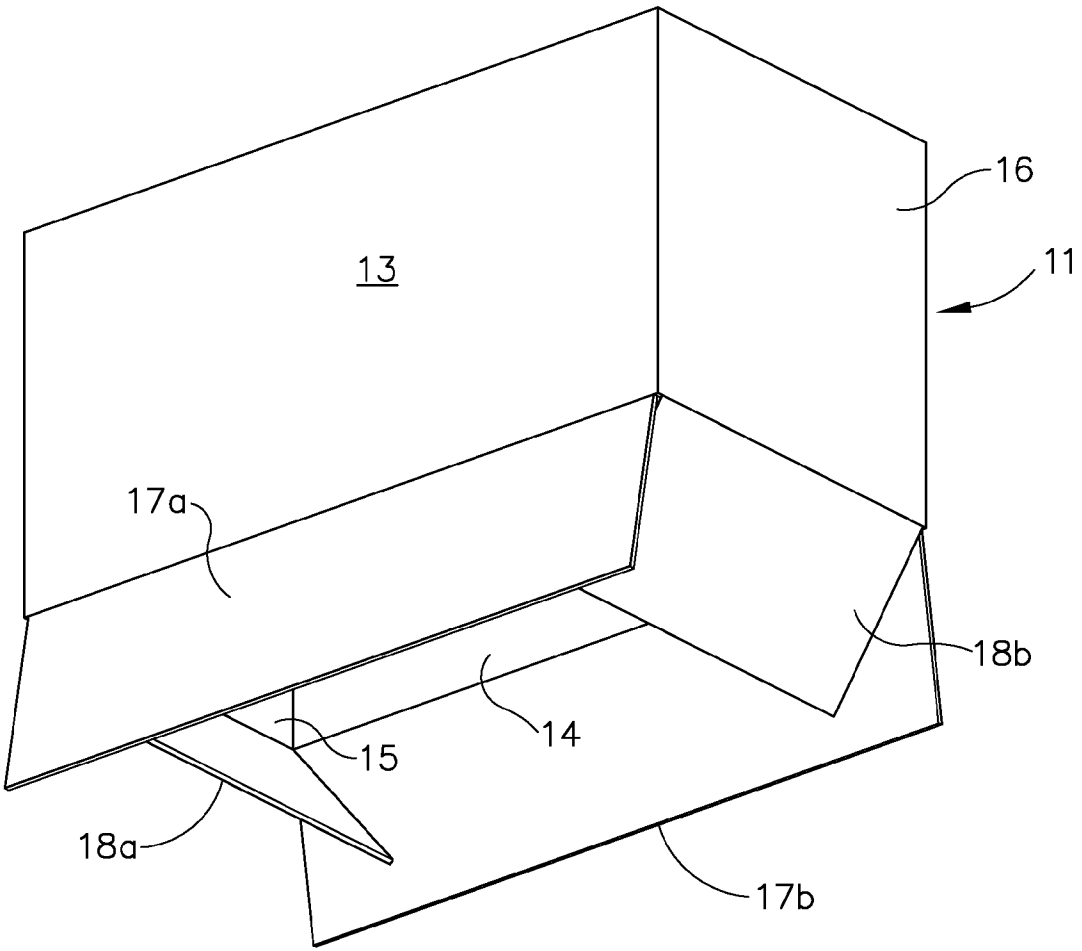
FIG. 8 is a bottom perspective view of the case in a partially erected condition, showing the major and minor bottom flaps being forwarded inwardly to close the bottom of the case.
Figure 9:
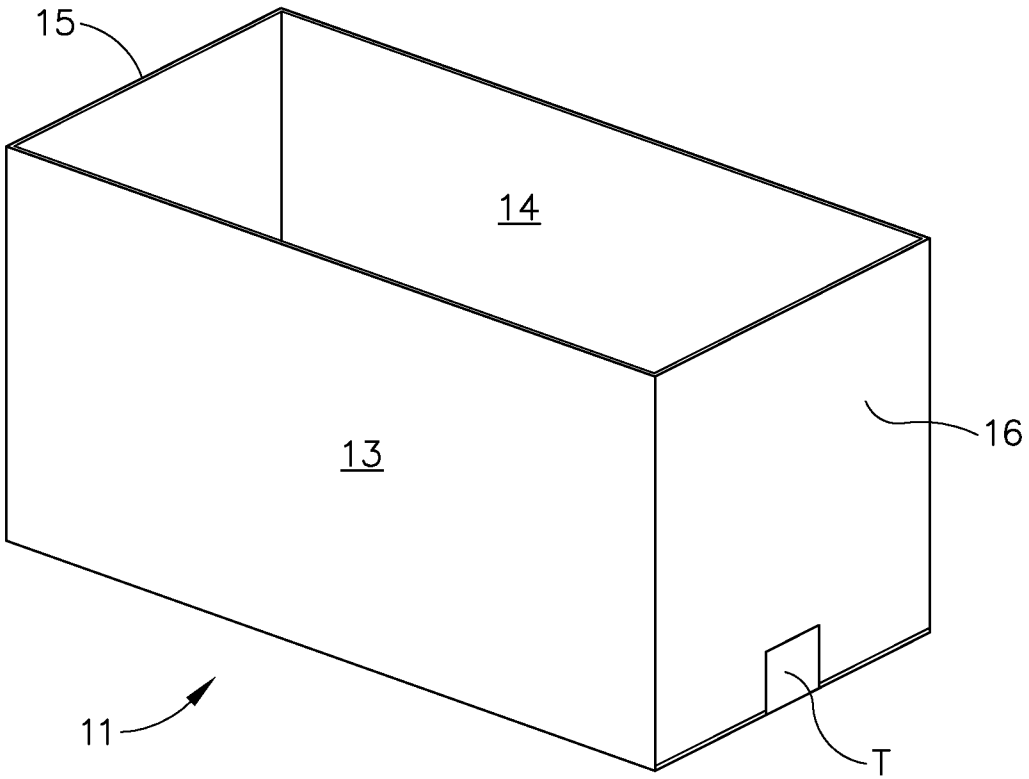
FIG. 9 is a top perspective view of the erected case, showing a construction wherein the bottom flaps are secured closed by the use of tape.

In use, the case 11 is erected into its opened up configuration and the bottom flaps are folded inwardly and secured as shown in FIGS. 8 and 9. The case is then filled with product and the cover 12 applied as depicted in FIGS. 2-4. The flanges 19*a*-19*d* are folded down and adhered to the upper outer surfaces of the side and end walls, and the protective panel 21 is folded inwardly over the lid panel 20 and adhered to the display panel 24. The completed and filled container is then shipped to a point of sale, where the container is placed on its side as shown in FIG. 5 and the protective panel and display panel are removed by pressing the punch-out tab 37 rearwardly and inserting a finger or fingers into the resultant opening and the opening 36 in the display panel and pulling outwardly to separate the protective panel and display panel from the container, leaving a display opening 40 for display of the product and easy access to it as shown in FIG. 6.

In a preferred embodiment, the tear lines 22 and 23 attaching the removable protective panel 21 to the lid panel are perforated lines comprising cuts one inch long spaced ¼ inch apart, and the tear lines 25, 26, 27 and 28 around the pop-out display panel and along the outer edge of flap 19*d* comprise four ⅛ inch nicks spaced two inches apart.

Figure 7:
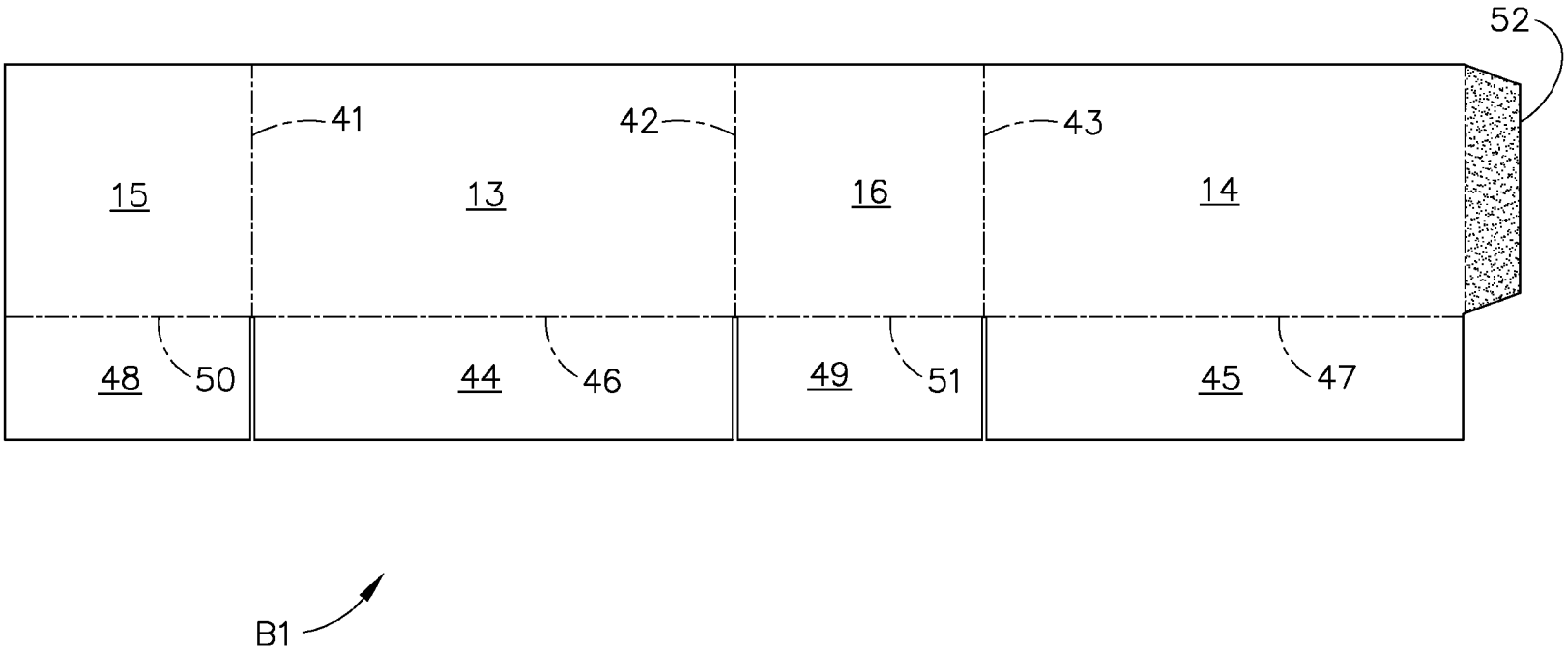
FIG. 7 is a plan view of the one-piece blank for making the case of the invention.

A blank B1 for making the case 11 used in the container of the invention is shown in FIG. 7. The blank comprises a first end wall panel 15 foldably joined along a first fold line 41 to a first side edge of a first sidewall panel 13, a second end wall panel 16 foldably joined along a second fold line 42 to a second side edge of the first sidewall panel, and a second sidewall panel 14 foldably joined along a first side edge thereof to the second end wall panel along a third fold line 43. Major bottom flaps 44 and 45 are foldably joined along fold lines 46 and 47 to the bottom edges of the first and second sidewall panels 13 and 14, respectively, and minor bottom flaps 48 and 49 are foldably joined along fold lines 50 and 51 to bottom edges of the end wall panels 15 and 16, respectively. A glue flap 52 is foldably joined to a second side edge of the second sidewall panel.

When the blank B1 is erected to form the case 11, the first and second sidewall and end wall panels are folded about the respective parallel fold lines 41, 42 and 43 and the glue flap 52 is adhered to the edge of end wall panel 13 opposite the fold line 41. The minor flaps 48 and 49 are then folded inwardly over the bottom, followed by the major flaps 44 and 45. The flaps are then secured by adhesive, staples, tape, or other suitable means. Tape T is shown in FIGS. 1-4.

Figure 10:
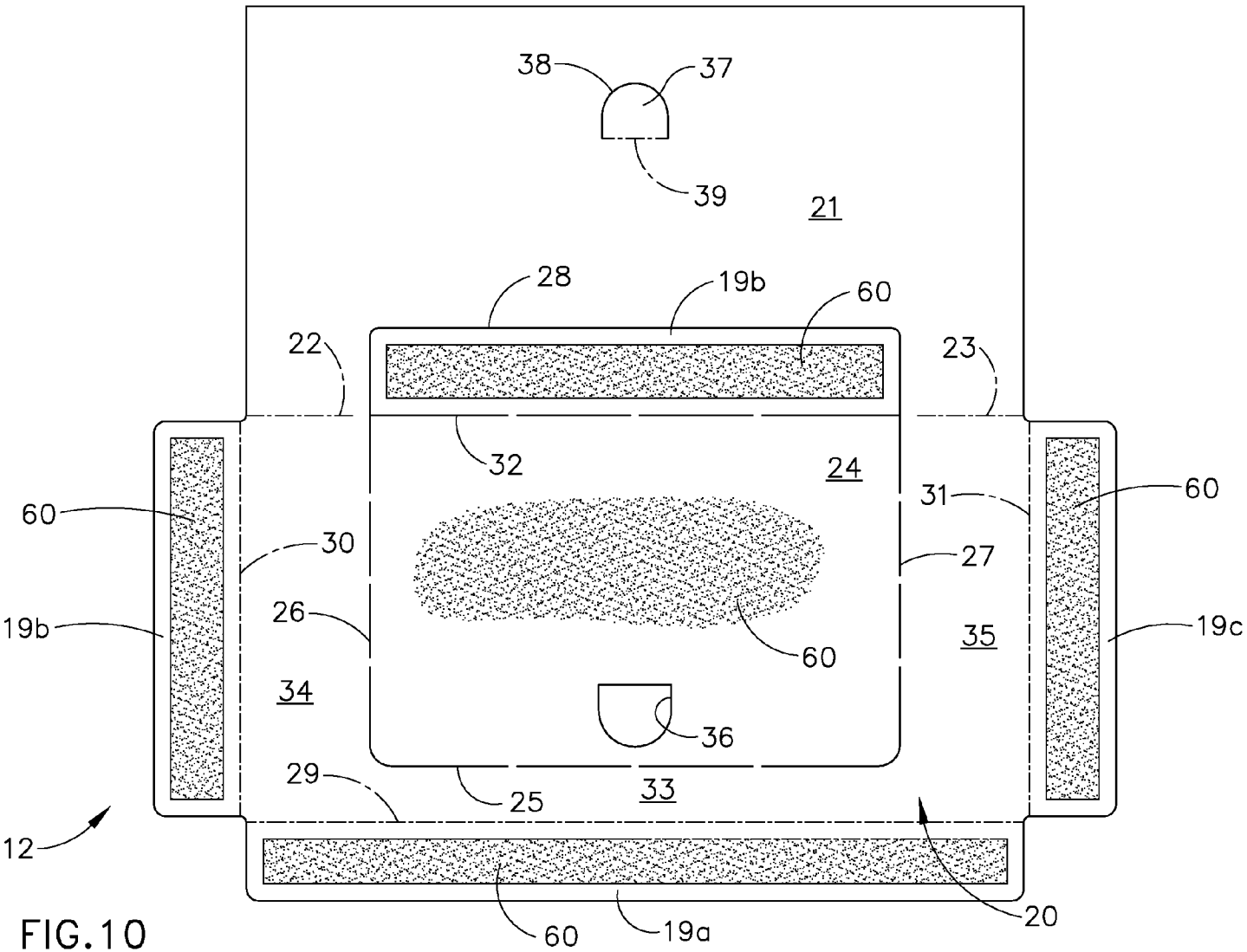
FIG. 10 is a top plan view of a blank for making the cover of the invention.

A blank B2 for making the cover 12 of the invention is shown in FIG. 10. The cover comprises a flat rectangular lid panel 20 and a protective panel 21 coextensive in length and width with the lid panel and foldably attached along spaced collinear frangible tear lines 22 and 23 to one edge of the lid panel, a tear-out display panel 24 extending over a substantial part of the lid panel and delineated by frangible tear lines 25, 26, 27 and 28, and flanges 19*a*-19*d* foldably attached along fold lines 29, 30, 31 and 32 to opposite side and end edges, respectively, of the lid panel. Fold line 32 is substantially collinear with the tear lines 22 and 23.

The tear lines 25, 26 and 27 are spaced inwardly from the edges of the lid panel, leaving surface areas 33, 34 and 35 at margins of the lid panel. Terminal end portions of the tear lines 26 and 27 extend past opposite ends of the fold line 32 and into the protective panel 21. Tear line 28 is connected between the terminal ends of tear lines 26 and 27 so that it lies in the protective panel spaced from and parallel to the fold line 32 and tear lines 22 and 23. The terminal end portions of tear lines 26 and 27 together with the tear line 28 and fold line 32 delineate flap 19*d*.

A generally D-shaped opening 36 is formed in the display panel 24 adjacent the edge thereof opposite the fold 32 and midway between opposite side edges thereof, and a correspondingly shaped punch-out tab 37 is formed in the protective panel 21 in a position to overlie the opening 36 when the protective panel is folded over the lid panel as shown in FIGS. 1, 4 and 5. Although the opening is D-shaped but other shapes such as semi-circle, square or the like are within the scope of the present invention.

The tab 37 is defined by a substantially U-shaped perforated line 38 terminating at opposite ends of a fold line 39.

Adhesive is applied to the flanges 19*a*-19*d* and to an area of the display panel, as indicated by the shaded areas 60.

In use, the flanges 19*a*-19*d* are folded downwardly and adhered to upper outer surfaces of respective side and end walls of the case 11, and the protective panel 21 is folded inwardly over the lid panel 20 and adhered to the display panel 24. The completed and filled container is then shipped to a point of sale, where the container is placed on its side as shown in FIG. 5 and the protective panel and display panel are removed by pressing the punch-out tab 37 inwardly and inserting a finger or fingers into the resultant opening and the opening 36 in the display panel and pulling outwardly to separate the protective panel and display panel from the container, leaving a display opening 40 for display of the product and easy access to it as shown in FIG. 6.

In a preferred embodiment, the tear lines 22 and 23 attaching the removable protective panel 21 to the lid panel are perforated lines comprising cuts one inch long spaced ¼ inch apart, and the tear lines 25, 26, 27 and 28 around the pop-out display panel and along the outer edge of flap 19*d* comprise four ⅛ inch nicks spaced two inches apart.

While particular embodiments of the invention have been illustrated and described in detail herein, it should be understood that various changes and modifications may be made in the invention without departing from the spirit and intent of the invention as defined by the appended claims.

What is claimed is:

1. A shipping container convertible into a display container at a point of sale, comprising:

a case having sidewalls, a closed bottom, and an open top; and a separate cover secured to and closing the open top of the case, the cover having a lid panel coextensive in length and width with the open top of the case, the lid panel having opposite side edges, a flange depending from each of the side edges of the lid panel, the flanges attached to upper outer surfaces of the case sidewalls to secure the cover to the case, a detachable display panel formed in the lid panel by first and second spaced apart weakened tear lines extending parallel to one another, and third and fourth spaced apart weakened tear lines joined to respective opposite ends of said first and second tear lines and extending parallel to one another and perpendicular to said first and second tear lines, said first, second, third and fourth tear lines extending around a border portion of the lid panel spaced inwardly from the side edges thereof, and a detachable protective panel foldably attached to one side edge of the lid panel by fifth and sixth colinear weakened tear lines extending perpendicular to the first and second tear lines, the protective panel folded inwardly over the lid panel and attached to the display panel along a fold, whereby removal of the protective panel carries the display panel with it and removes the display panel to form a display opening in the lid panel for display of and access to product contained in the container.

2. The shipping container convertible into a display container of claim 1 wherein the detachable display panel extends over a substantial portion of the lid panel, and surface portions of the lid panel between the first, second and third tear lines and the side edges of the lid panel define surfaces for receipt of high end graphics.

3. The shipping container convertible into a display container of claim 1 wherein the first, second and third weakened tear lines are spaced inwardly from the edges of the lid panel, leaving surface areas at margins of the lid panel.

4. The shipping container convertible into a display container of claim 1 wherein terminal end portions of the first and second tear lines extend past opposite ends of said fold joining the protective panel to the display panel and into the protective panel.

5. The shipping container convertible into a display container of claim 4 wherein the fourth tear line is connected between the terminal ends so that it lies in the protective panel spaced from and parallel to said fold and the collinear fifth and sixth tear lines.

6. The shipping container convertible into a display container of claim 4 wherein the terminal end portions of the first and second tear lines together with the fourth tear line and said fold delineate a flap.

7. The shipping container convertible into a display container of claim 4 wherein the detachable display panel comprises an opening formed adjacent the edge thereof opposite the fold and midway between opposite side edges thereof.

8. The shipping container convertible into a display container of claim 7 wherein the protective panel comprises a punch-out tab formed therein which corresponds to said opening in a position to overlie the opening when the protective panel is folded over the lid panel.

9. A shipping container convertible into a display container at a point of sale, comprising:

a case having sidewalls, a closed bottom, and an open top; and a separate cover secured to and closing the open top, the cover having:

a lid panel coextensive in length and width with the open top of the case, the lid panel having opposite side edges, a flange depending from each of the side edges of the lid panel, the flanges attached to upper outer surfaces of the case sidewalls to secure the cover to the case, a detachable display panel formed in the lid panel by weakened tear lines in the lid panel extending around a border portion of the lid panel spaced inwardly from the side edges thereof, the display panel extending over a substantial portion of the lid panel, and surface portions of the lid panel between the tear lines and the side edges of the lid panel defining surfaces for receipt of high end graphics, and a detachable protective panel foldably attached to one side edge of the lid panel by weakened tear lines, the protective panel folded inwardly over the lid panel and attached to the display panel, whereby removal of the protective panel carries the display panel with it and removes the display panel to form a display opening in the lid panel for display of and access to product contained in the container.

10. A shipping container convertible into a display container at a point of sale, comprising:

a case having sidewalls, a closed bottom, and an open top; and a separate cover secured to and closing the open top, the cover having:

a lid panel coextensive in length and width with the open top of the case, the lid panel having opposite side edges, a flange depending from each of the side edges of the lid panel, the flanges attached to upper outer surfaces of the case sidewalls to secure the cover to the case, a detachable display panel formed in the lid panel by weakened tear lines in the lid panel extending around a border portion of the lid panel spaced inwardly from the side edges thereof, the display panel extending over a substantial portion of the lid panel, and surface portions of the lid panel between the tear lines and the side edges of the lid panel defining surfaces for receipt of high end graphics, the detachable display panel includes an opening formed adjacent one edge thereof and midway between opposite side edges thereof, and a detachable protective panel foldably attached to one side edge of the lid panel by weakened tear lines, the protective panel includes a punch-out tab formed therein which correspond to the opening in a position to overlie the opening when the protective panel is folded over the lid panel, the protective panel folded inwardly over the lid panel and attached to the display panel, whereby removal of the protective panel carries the display panel with it and removes the display panel to form a display opening in the lid panel for display of and access to product contained in the container.

* * * * *